United States Patent [19]

Gronbech

[11] 4,407,151

[45] Oct. 4, 1983

[54] ROLLING MILL

[75] Inventor: Robert W. Gronbech, Sheffield, England

[73] Assignee: Davey-Loewy Limited, Yorkshire, England

[21] Appl. No.: 282,717

[22] Filed: Jul. 13, 1981

[30] Foreign Application Priority Data

Jul. 17, 1980 [GB] United Kingdom ..... 8023335
Sep. 23, 1980 [GB] United Kingdom ..... 8030666

[51] Int. Cl.[3] ..... B21B 29/00
[52] U.S. Cl. ..... 72/241; 72/243; 72/247
[58] Field of Search ..... 72/199, 241, 243, 245, 72/246, 247, 366

[56] References Cited

U.S. PATENT DOCUMENTS 4,222,255 9/1980 Lehmann ..... 72/243

FOREIGN PATENT DOCUMENTS 53-48053 5/1978 Japan ..... 72/241
55-10366 1/1980 Japan ..... 72/241
55-133805 10/1980 Japan ..... 72/241

*Primary Examiner*—Francis S. Husar
*Assistant Examiner*—Jonathan L. Scherer
*Attorney, Agent, or Firm*—Lee, Smith & Jager

[57] ABSTRACT

A rolling mill having at least a pair of work rolls (12, 13) each supported by a back-up roll (14, 15) has at least one roll (16) of hollow construction to give the mill compliance. The hollow roll (16) may contain an arbor (20) to give local stiffness to the roll as required by the shape of the material (17) entering the mill.

7 Claims, 12 Drawing Figures

ROLLING MILL

This invention relates to rolling mills particularly for rolling elongate metallic strip, such as steel strip.

Rolling mills for rolling down steel strip as supplied by a roughing mill, are usually designed for maximum stiffness, and to that end have solid work rolls and massive back-up rolls intended to prevent bowing of the work rolls under the rolling load. One consequence of that arrangement is that, when the entering strip has a non-uniform profile across its width, those parts having a greater thickness are subject to greater reduction than those parts of lesser thickness and are elongated in the length dimension of the strip to a greater degree. The result is bad shape, usually in the form of strip with "a full centre" or "full edges" and the strip is no longer flat.

Strip with good shape is generally preferred to strip with a good, or uniform profile, even if the former is associated with a slightly non-uniform profile. Ideally, the strip finally emerging from the rolling process should have both good shape and good profile.

In the present invention, compliance is introduced into a mill by having a roll or rolls, of hollow construction. The compliant nature of the hollow roll or rolls is then such that the strip is subject to substantially uniform reduction across its width, regardless of its entering shape and its flatness does not deteriorate.

It is an advantage if the stiffness of the hollow roll or rolls can be made to vary along the axial length of the roll or each roll so that bad shape in the incoming strip may be improved. For that purpose, there may be means within the hollow roll for increasing its stiffness over some parts of its length relative to the remainder. That may be done by introducing support discs at selected points along the roll length, or by inserting a closely fitting plunger for a given length of the roll.

It is thought desirable that a mill should be stiff only over the width of the material being rolled; outside the confines of the strip width, the mill should be relatively compliant. A mill having such a stiffness profile is believed to avoid the over-rolling of the edges of the material being rolled and to facilitate work roll bending designed to control cross-sectional shape of the rolled material. By using a hollow roll in accordance with the present invention as, for example, the intermediate roll of a five-high mill or each of the intermediate rolls of a six-high mill, the aforementioned stiffness profile may be achieved.

Thus, the invention may be applied to a four-high mill, a five-high mill or a six-high mill. In the first case, one or both of the rolls can be hollow. In a five-high mill, a hollow intermediate roll is interposed between one of the works rolls, and its back-up roll, while in a six-high mill having an intermediate roll between each work roll and its back-up roll one or both of the intermediate rolls may be hollow.

Figure 1:
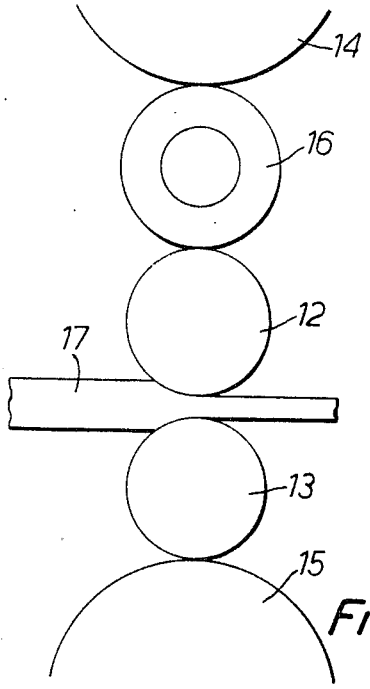
Figure 2A:
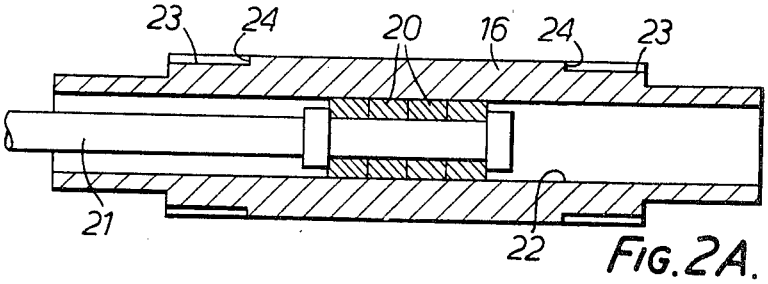
Figure 2B:
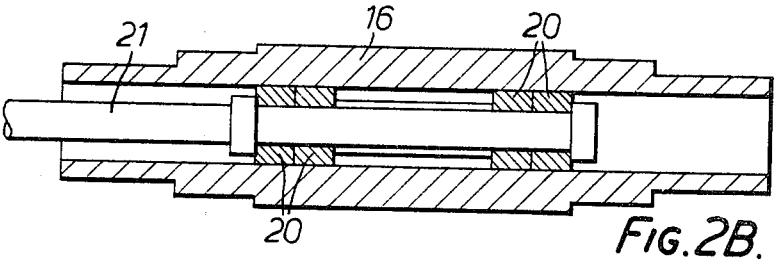
Figure 3:
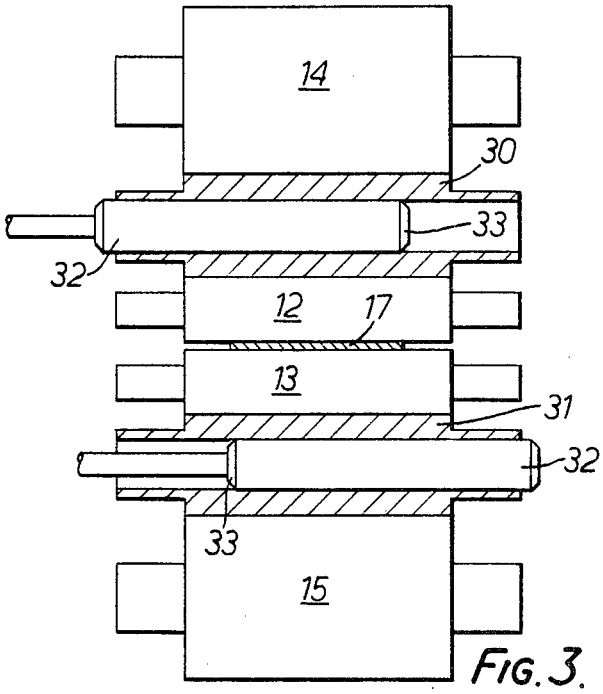
Figure 4:
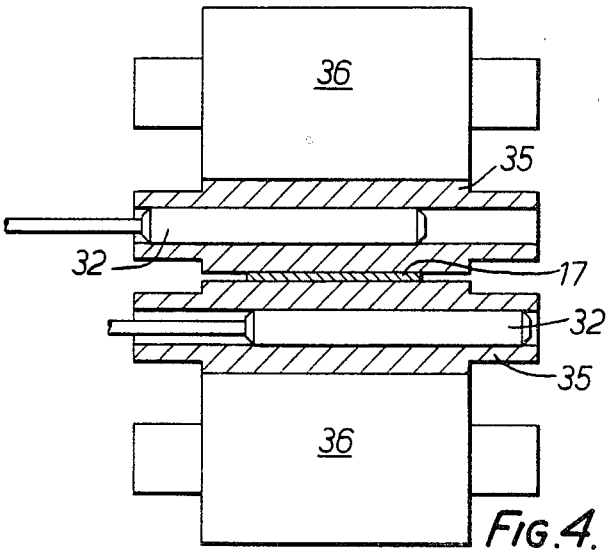
Figure 10:
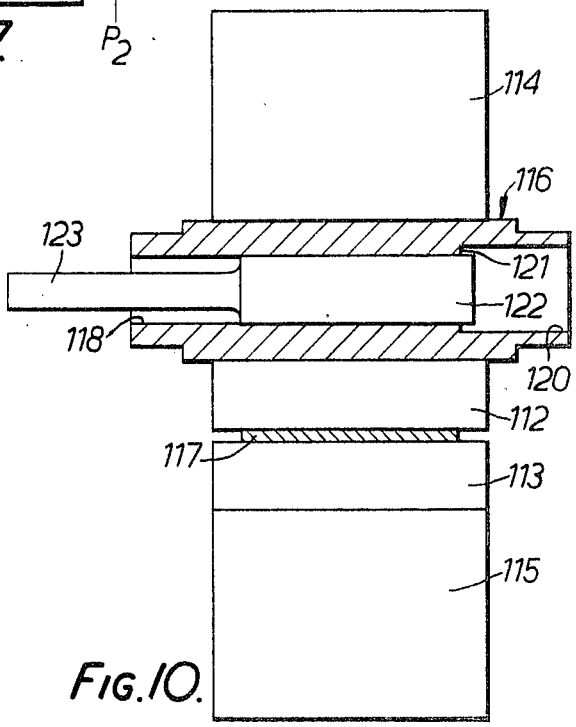
Figure 11:
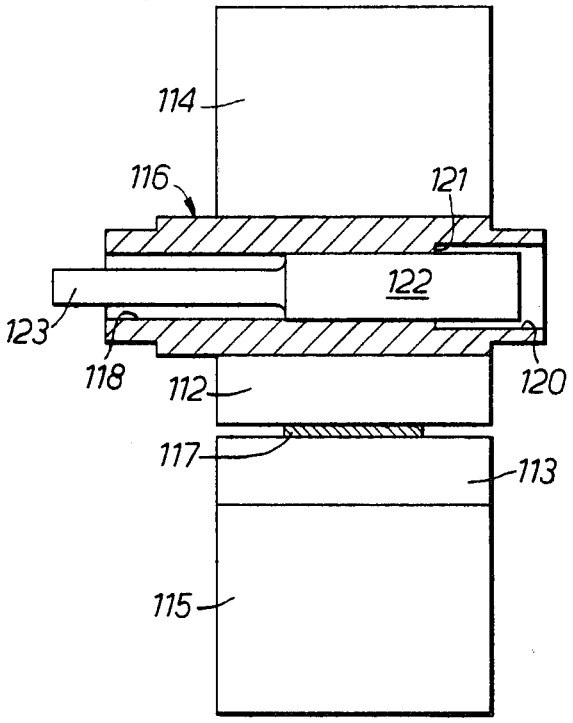

The invention will be more readily understood by way of example from the following description of rolling mills in accordance therewith, reference being made to the accompanying drawings, in which FIG. 1 illustrative a five-high mill with a hollow intermediate roll, FIGS. 2A and 2B show a variable stiffness hollow roll in two different arrangements, FIGS. 3 and 4 illustrate respectively a six-high and a four-high mill with stiffened hollow rolls, FIGS. 5 to 9 show mills with a hollow roll or rolls containing a central arbor or arbors, and FIGS. 10 and 11 show in schematic vertical section a five-high mill having a composite intermediate roll which in FIG. 10 is arranged to roll wide strip and in FIG. 11 narrow strip.

The mill of FIG. 1 is represented by its rolls only, the mill housings and the drive being of well known form. The mill is shown as having two work rolls 12 and 13, two back-up rolls 14 and 15, and an intermediate roll 16 between work roll 12 and its back-up roll 14. Intermediate roll 16 is hollow as shown in order to introduce transverse compliance into the mill. In other words, the softness of the roll allows the roll to comply with variations of rolling load along its length due for example to variations in thickness of the incoming work 17 across its width. As a consequence the work is reduced evenly across its width and the flatness of the work is not detrimentally affected.

If desired, the mill may have a second intermediate roll between the rolls 13 and 15; the second intermediate roll may be hollow, like roll 16, or solid.

The hollow roll 16 may have means causing the roll to have a compliance which varies along its length. A roll with such means is illustrated in FIG. 2A and 2B, where the means are constituted by a number of support discs 20 which are threaded on an arbor 21 and which are a close fit within the bore 22 of the roll 16; advantageously the discs 20 have an interference fit within the bore 22, but can be moved axially along the roll by expanding the roll by liquid under pressure.

The discs 20 are axially located according to the shape or flatness of the incoming work 17. Thus, if the incoming strip has wavy edges due to a greater reduction of the edge portions having taken place in a previous rolling operation, relative to the centre part of the strip, the support discs 20 are located centrally as shown in FIG. 2A, so that the mill is stiffer in the centre than at the edges, the strip is given a greater reduction in the centre than at the edge parts, and the flatness is improved. Similarly, if the incoming strip 17 exhibits centre buckle, i.e. the strip has been subject to a greater reduction at the centre than at the edges, the discs are arranged as shown in FIG. 2B to give the roll 16 a greater stiffness at the edges than at the centre; in FIG. 2B, the discs 20 are separated so as to line up with the edges of the strip, the central part of the roll being free of stiffening discs.

When rolling to improve flatness as described above, the second intermediate roll (not shown) need not have the same hollow construction as shown in FIGS. 2A and 2B, but if the rolls are similarly constructed the discs are similarly arranged when rolling strip with wavy edges or with a wavy centre. However to improve quarter buckle, both intermediate rolls should be hollow and provided with the support discs 20. Then, if the incoming strip has suffered greater elongation at the quarter points between the edges and the centre of the strip than elsewhere, the discs of one intermedite roll are positioned as in FIG. 2A while those of the other intermediate roll are positioned as in FIG. 2B. If the strip has been elongated less at the quarter points than elsewhere, the disc arrangement is the same, except that fewer discs are provided in the FIG. 2A roll, with the consequence that the quarter points are given a smaller reduction than elsewhere.

The barrel of the intermediate roll or of each intermediate roll 16 has usually the same diameter over its length. On the other hand, the barrel may be relieved as shown at 23 in FIGS. 2A and 2B, forming steps 24 aligned with the edges of the work. Stepped intermediate rolls reduce the over-rolling of the strip edges, particularly where work-roll bending is employed.

In FIG. 3, there are two intermediate rolls 30 and 31 each of which is hollow and each of which is stiffened by an adjustable, close fitting, arbor 32 having tapered ends 33. The arbosr 32 are positioned so that the end of one lines up respectively with one edge of the strip 17, while the opposite end of the other arbor lines up with the other strip edge, as shown. The mill is then relatively stiff over the width of the strip 17 and relatively soft outside the strip width. Over-rolling of the strip-edges is thus reduced and work-roll bending is facilitated. FIG. 4 shows a four-high mill with work rolls 35 and back-up rolls 36 and with each work roll constructed similarly to the intermediate rolls 30, 31 of FIG. 3. Profile of the rolled strip is again controlled by work roll bending.

Figure 5:
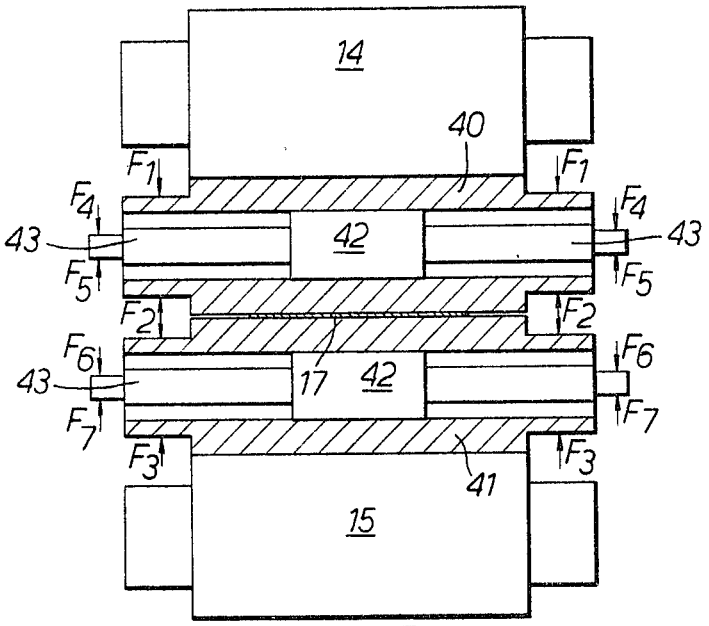
Figure 6:
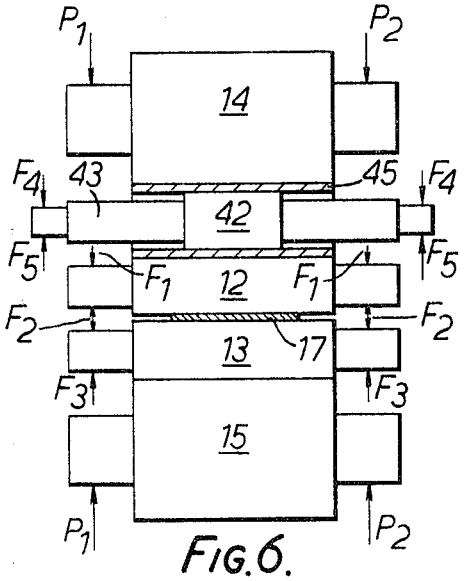
Figure 7:
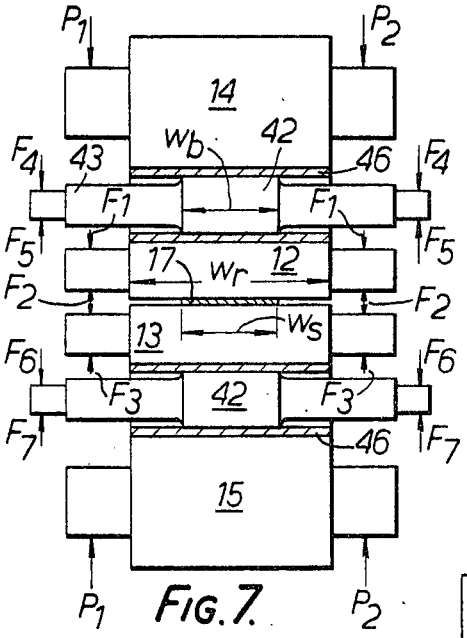

In a further variant which is illustrated in FIG. 5, each of the work roll 40, 41 of a four-high mill is hollow and contains an arbor 42. The arbor 42 is an interference fit with the bore of its roll and extends over the central third of the length of the roll 40, 41. The arbors are integral with shafts 43 of lesser diameter extending beyond the ends of the roll. Hydraulic piston and cylinder assemblies are connected to the ends of the shafts 43 as represented by the forces $F_4$–$F_7$, to bend the arbors 42 and hence the centre parts of the rolls 40, 41. That bending equipment can replace or supplement the conventional work roll bending represented by the forces $F_1$–$F_3$ and has the same function; however, the roll bending is concentrated at the roll centres which are normally subject to little bending when the bending forces are applied to the roll ends.

By selecting what bending forces are applied to the rolls 40, 41 and to the ends of the shafts 43, transverse rolling of the strip 17 can be varied as required. Thus, 1. applying the bending forces $F_1$ and $F_4$ would result in a large centre crown in the strip and in the strip edges being rolled i.e. a loose edge.

2. applying the bending forces $F_4$ and $F_2$ would result in a smaller centre crown but in relieving the edges i.e. a tight edge.

3. applying the bending forces $F_2$ and $F_5$ results in a heavy roll crown i.e. the strip has a rolled centre and a tight edge, and 4. applying the bending forces $F_1$ and $F_5$ results in rolling the strip centre and easing the tight strip edge.

Figure 8:
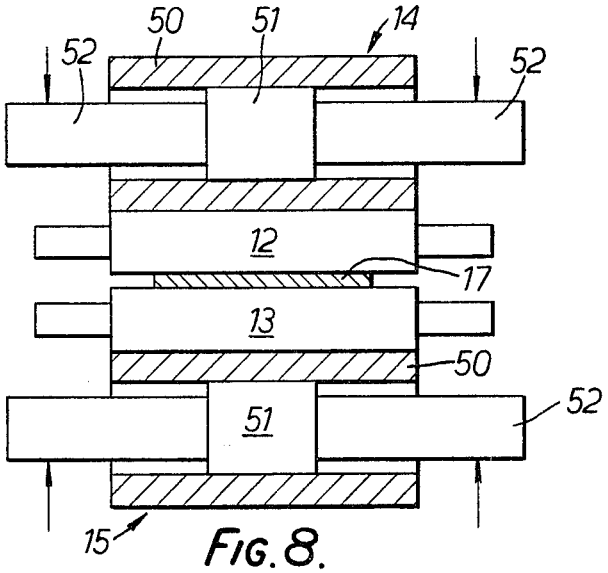
Figure 9:
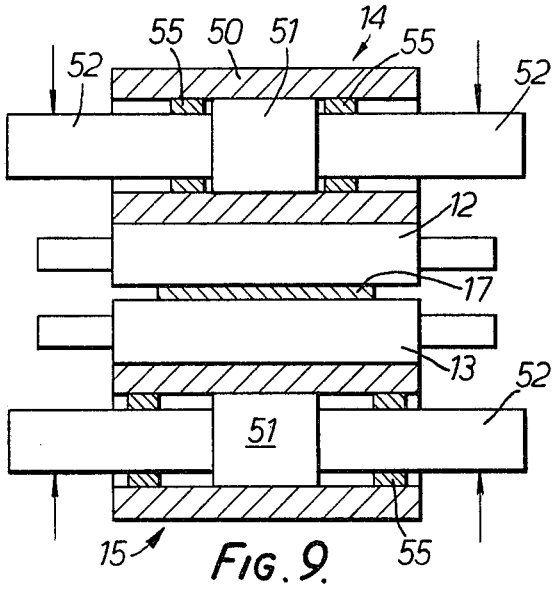

The concept of a hollow roll with a central arbor can be applied to the intermediate roll 45 of a five-high mill (FIG. 6) or to each of the intermediate rolls of a six-high mill (FIG. 7) or to one or each of the back-up rolls (FIGS. 8 and 9). In these cases, the axial length of the arbor 42 is less than the effective length of the roll barrel and may be less than the width of the strip 17. Roll bending systems represented by the bending forces $F_1$–$F_7$ are applied to the work rolls and to the intermediate roll 45 or intermediate rolls 46 and extends the influence of roll bending control across the full width of the strip.

In the roll configurations of FIG. 8 and 9, each back-up roll 14, 15 is shown as consisting of a sleeve 50 which is centrally stiffened by an arbor 51. Arbor 51 has integral stub shafts 52 carried in bearings in the windows of the mill housing; the sleeves 50 themselves are unrestrained at their ends and remain isolated from much of the bending effect of the rolling load on the arbors 51. As the width of the strip 17 increases, the sleeves 50 tend to deflect in the opposite sense to the back-up rolls of normal four high mills, i.e. the outer ends of the upper sleeve 50 tend to deflect downwardly and the outer ends of lower sleeve 50 upwardly. Thereby, the total roll stack deflects or bowing is reduced relative to that of the rolls of a normal mill having solid back-up rolls.

In FIG. 9, the central arbor 51 is supplemented by adjustable spacer rings 55 carried on the shafts 52 and providing further local support for the sleeves 50. The positions of rings 55 can be adjusted axially to influence the transverse deflections of the sleeves 50. It will be appreciated that this technique employs only the rolling load reaction force on the back-up bearing plates and does not require additional external forces, such as those applied in back-up bending, in order to influence the back-up bending deflections.

FIGS. 10 and 11 illustrate another form of stiffened hollow roll which, when used as the intermediate roll of a five-high mill has the properties of the six-high mill of FIG. 3. In FIGS. 10 and 11, the work rolls of the mill are indicated at 112 and 113, the back-up rolls at 114 and 115, the intermediate roll at 116 between the upper work roll 112 and the upper back-up roll 114, and the metal strip to be rolled at 117. The work rolls 112 and 113 have as before conventional roll bending equipment to control shape with, if required, a strip shape sensor downstream of the mill to control the work roll bending equipment. Instead of, or in addition to, the work roll bending equipment other means for control strip shape may be provided, such as thermal cambering of the rolls by the control of the cooling sprays along the length of the rolls.

The intermediate roll 116 has a barrel length greater than that of the other rolls of the mill. The roll 116 is hollow having a bore 118 which has a uniform diameter over the greater part of its length from one end, but which has an enlarged diameter at 120 over the remainder of its length, a step 121 being formed where the diameter changes. An arbor 122 having a length rather less than that of the work rolls is a close fit in that part of the bore 118 of smaller diameter, but is axially adjustable therein; thus the arbor may be an interference fit in the bore, adjustment being made possible by expanding the roll by liquid under pressure. The arbor has a shank 123 by which it can be moved axially in the roll.

Intermediate roll 116 is itself axially adjustable relative to the other rolls, being mounted and driven for that purpose as described in British Pat. No. 1351074. Alternatively the arbor 122 may have shanks or spindles similar to 123 at both ends with those spindles carried in bearings which are mounted for axial adjustment. In the latter case, the intermediate roll itself is not supported in bearings but is adjustable relative to its arbor.

The mill may be used for rolling strip of any width up to the maximum for which the mill is designed, the roll 116 and the arbor 122 being adjustable axially according to the width of the strip to be rolled. As shown in both FIG. 10 and FIG. 11, roll 116 is adjusted to bring the step 121 into the same vertical plane as one edge of strip 117 and the arbor 122 is adjusted in roll 116 so that its shank end is in the same vertical plane as the other strip edge, the arbor 122 then overlying the strip width. The result is that the mill has the required stiffness over only the strip width, but has greater compliance outside the strip width. As the left hand side, the greater compliance is achieved by termination of the stiffening arbor at the left hand strip edge and, at the right hand side, by the enlarged bore 120 which prevents the arbor stiffening the roll beyond the right hand strip edge.

If desired, the arbor 122 may be extended with a slight tapering at the left hand end to give a progressive increase in compliance. Similarly the step 121 may be tapered.

The mill illustrated in FIGS. 10 and 11 has the advantage that only a single adjustable intermediate roll is required in order to adapt the mill to any strip width. Further, because the intermediate roll is longer than the other rolls, and is therefore in contact with work rolls 112 over the entire length of the latter, regardless of the axial position of the intermediate roll, marking of the work roll is avoided.

I claim:

1. In a rolling mill for rolling elongate material, which mill has at least four rolls including two work rolls and a back-up roll for each said work roll, and in which one of said rolls of said mill has axially adjustable stiffness, the improvement in which said one roll is hollow with an axial bore therein, and in which said bore contains a plurality of support discs, each of which is a close fit within said bore and each of which is axially adjustable within said bore.

2. The improvement of claim 1, in which each said disc is an interference fit within said bore.

3. In a rolling mill for rolling elongate material, which mill has at least four rolls including two work rolls and a back-up roll for each said work roll, and in which one of said rolls of said mill has axially adjustable stiffness, the improvement in which said one roll having axially adjustable stiffness has an axial bore therein and is axially adjustable relative to the remaining rolls of said mill and an axially adjustable stiffening arbor is located within said bore, whereby the effective end of said one roll can be brought into substantial alignment with one widthwise edge of said material with the effective end of said arbor in substantial alignment with the other widthwise edge of said material, whereby said mill is relatively stiff over the width of said material and relatively compliant beyond the edges of said material.

4. A five-high rolling mill as claimed in claim 1, wherein said bore has a first diameter over the major part of the axial length of said intermediate roll and a second larger diameter over the remaining part of said axial length, and said arbor extends into said remaining part.

5. A five-high rolling mill for rolling elongate material and comprising:

two work rolls;

a back-up roll for each said work roll;

an intermediate roll between one of said work rolls and its said back-up roll;

said intermediate roll being axially adjustable relative to said work rolls and said back-up rolls, and having an axial bore therein;

an axially adjustable stiffening arbor within said bore, the arrangement being such that the effective end of said intermediate roll can be brought into substantial alignment with one widthwise edge of said material with the effective end of said arbor in substantial alignment with the other widthwise edge of said material, whereby said mill is relatively stiff over the width of said material and relatively compliant beyond the edges of said material.

6. A rolling mill as claimed in claim 5, including means for bending at least one of said work rolls for the control of the shape of said material.

7. A rolling mill as claimed in claim 6, further including means for applying bending forces to said arbor, or at least one of said arbors.

* * * * *